US005626639A

United States Patent [19]

King

[11] Patent Number: 5,626,639

[45] Date of Patent: May 6, 1997

[54] ABRASIVE ARTICLES AND METHOD OF MAKING THE SAME

[75] Inventor: William B. King, Nuneaton, United Kingdom

[73] Assignee: Minnesota Mining and Manufacturing Company, St. Paul, Minn.

[21] Appl. No.: 559,200

[22] Filed: Nov. 13, 1995

[30] Foreign Application Priority Data

Nov. 19, 1994 [GB] United Kingdom ..... 9423268

[51] Int. Cl.[6] ..... B24D 11/00

[52] U.S. Cl. ..... 51/297; 51/293; 156/60; 156/289; 156/297

[58] Field of Search ..... 51/293, 297; 156/60, 156/289, 297

[56] References Cited

U.S. PATENT DOCUMENTS

| | | | |
|---|---|---|---|
| 3,225,916 | 12/1965 | Field et al. | 56/206 |
| 3,267,623 | 8/1966 | Block | 51/406 |

FOREIGN PATENT DOCUMENTS

| | | | |
|---|---|---|---|
| 0021348 | 1/1981 | European Pat. Off. | B24D 11/00 |
| 3844261 | 12/1988 | Germany . | |
| 59-124576 | 11/1984 | Japan | B24D 11/00 |
| 2108080 | 5/1983 | United Kingdom | B24D 11/00 |
| 2275007 | 8/1994 | United Kingdom . | |

*Primary Examiner*—Deborah Jones
*Attorney, Agent, or Firm*—Gary L. Griswold; Walter N. Kirn; Richard Francis

[57] ABSTRACT

An abrasive article is provided which comprises a substrate having a surface bearing and abrasive layer and an opposite surface having a layer of pressure sensitive adhesive and a protective liner covering the layer of pressure sensitive adhesive. The liner includes a lift flap secured thereto which does not extend beyond the perimeter of the liner and has a free portion accessible to finger grip. A method of making an abrasive article is also provided which comprises providing a web having an abrasive layer on one side and a layer of pressure sensitive adhesive on an opposite side and a protective liner covering the layer of pressure sensitive adhesive, providing a strip of lift material having a region bearing an adhesive layer and a non-adhesive region, applying the strip to the liner of the web, and cutting the web and strip to form the abrasive article such that the liner of the abrasive material has a lift flap which does not extend beyond the perimeter of the liner and has a free portion accessible to finger grip.

14 Claims, 1 Drawing Sheet

ABRASIVE ARTICLES AND METHOD OF MAKING THE SAME

RELATED PATENT APPLICATION

This application claims priority from UK Application No. 9423268.3 filed Nov. 18, 1994.

BACKGROUND OF THE INVENTION

1. Field of the Invention

This invention relates to abrasive articles and to their preparation. In particular, the invention relates to abrasive sheet materials having a layer of pressure-sensitive adhesive for attachment of the abrasive sheet to the back-up pad of a sanding implement.

2. Background Art

Abrasive sheet materials comprising a substrate, e.g., paper, having a first major surface bearing an abrasive layer and a second major surface having a layer of pressure-sensitive adhesive thereon are known. The abrasive sheets are generally in the form of rectangles or circular discs and the pressure-sensitive adhesive is used to attach the abrasive sheet to the back-up pad of a sanding implement, e.g., a rotary or orbital sanding device. When such abrasive sheets are manufactured it is common practice to protect the pressure-sensitive adhesive layer with a liner in order to prevent the adhesive from becoming contaminated. The liners generally comprise a plastic film or paper which may be treated with a release material, e.g., a silicone.

The process of manufacturing such abrasive articles generally comprises forming a web comprising a substrate having a first major surface bearing an abrasive layer and the second major surface having a layer of pressure-sensitive adhesive and a protective liner covering the pressure-sensitive adhesive. Individual abrasive articles are then cut from the web. The abrasive articles may have any desired shape but are generally rectangular or circular. The cutting operation generally results in the abrasive and liner having perimeters which are coterminous, i.e., the cutter simultaneously cuts the abrasive substrate and liner.

One of the problems associated with abrasive articles manufactured in such a manner is that it is difficult for the user to peel the protective liner from the pressure-sensitive adhesive. This problem arises because it is difficult for the user to separate an edge of the liner from the adjacent edge of the abrasive material. Once an edge has been separated it is easy to peel the liner away from the adhesive.

This problem has been overcome by providing the liner with a lift flap or finger lift. One method of providing a lift flap comprises adhering a circular tab to the outer surface of the liner in such a manner that it projects beyond the perimeter of the liner, the projecting portion being free of adhesive and providing a lift flap for removing the liner. Whilst this arrangement is effective from the point of view of the end user it involves the application of tabs to each individual abrasive article.

A second method of providing a lift flap comprises cutting the web of abrasive material and protective liner in such a manner that the perimeters of the abrasive material and liner are not coterminous and the perimeter of the liner extends beyond that of the abrasive material to define a lift flap. Again, this arrangement is satisfactory from the point of view of the end user but requires precisely controlled conditions of the cutting operation in order to cut the abrasive material in some regions without cutting the protective liner.

A further method of overcoming the problem is to cut the individual abrasive materials prior to application of the liner and to individually apply the abrasive materials to an oversized liner. For example, circular discs have been applied to a square liner. This process is not efficient and utilizes large amounts of protective liner.

DE-3844261A. published Jul. 5, 1990, discloses a reusable adhesive product and an abrasive or polishing article which is fixed on by adhesion having an underlay with a suitable top coating and pressure-sensitive adhesive layer on the other side. The adhesive layer has a peel-off composite consisting of a substrate and pressure-sensitive tacky layer on the under side; part of the adhesive layers have non-tacky segments for gripping purposes. The non-tacky grip areas, which enable the peel-off of the part to be removed are formed by interposing a strip of tabbing tape, e.g., a strip of release material, between the adhesive and the substrate at the edge of the abrasive material to provide a free edge for gripping by the user.

It is an object of the present invention to provide an alternative form of lift flap for use on the liner of abrasive articles.

SUMMARY OF THE INVENTION

Therefore according to the invention there is provided an abrasive article comprising a substrate having a first major surface bearing an abrasive layer and a second major surface having a layer of pressure-sensitive adhesive and a protective liner covering said layer of pressure-sensitive adhesive, the liner having a perimeter coterminous with the perimeter of said substrate in which the liner has a lift flap secured thereto with a greater bond strength therebetween than the bond strength developed between the liner and the pressure-sensitive adhesive, the lift flap not extending beyond the perimeter of the liner and having free portion accessible to finger grip.

According to a further aspect of the invention there is provided a method of making an abrasive article which comprises:

- providing a web comprising a substrate having a first major surface bearing an abrasive layer and a second major surface bearing a layer of pressure-sensitive adhesive and a protective liner covering said layer of pressure-sensitive adhesive,
- providing a strip of lift material comprising a backing having a major surface having a region bearing an adhesive layer and a non-adhesive region free from adhesive,
- applying said strip to the liner of the web,
- and cutting said web and strip to form abrasive articles such that the liner of the abrasive article has a lift flap secured thereto to aid removal of the liner from the pressure-sensitive adhesive, the lift flap not extending beyond the perimeter of the liner and having free portion accessible to finger grip.

The term "perimeter" used herein refers to the peripheral outer edge or boundary of a layer. The term "coterminous" used herein means that neither peripheral outer edge of the two layers of interest overlaps or extends beyond the other and so that the outermost edges of the two layers of interest are in alignment in a view taken perpendicular to imaginary planes coextensive with the major surfaces of the substrate.

The reference to the lift flap not extending beyond the liner means it does not overlap the perimeter of the liner in a view taken perpendicular to imaginary planes coextensive with the major surfaces of the substrate.

It has been found that by a simple modification of the manufacturing process, it is readily possible to provide lift flaps on the liner of abrasive articles having a coating of pressure-sensitive adhesive. The modification comprises applying a strip of lift material to the liner on the web in the region where the edges of the abrasive articles will be cut. The strip of lift material either comprises a backing having a central adhesive stripe and adhesive-free stripes on either side thereof or a central adhesive-free stripe with stripes of adhesive on either side thereof. After the cutting operation, these lift materials will result in an abrasive article in which the lift flap is secured to the liner adjacent the edge of the liner and in which the free portion of the lift flap is adjacent the edge of the liner respectively.

The abrasive article may comprise any coated abrasive material in sheet form. Generally, the article comprises a flexible substrate, such as paper, cloth or plastic film, having an abrasive material coated on one major surface thereof, and a pressure-sensitive adhesive coated on the other major surface thereof. The abrasive material may be coated on the substrate (as a continuous web) by any of the methods commonly used in the coated abrasives industry, and generally comprises an abrasive mineral and a bond system. The preferred abrasive minerals include silicon dioxide, aluminum oxide, white aluminum oxide, ceramic aluminum oxide, cerium oxide, diamond, cubic boron nitride, silicon carbide, etc., of any suitable particle size, and including mixtures of different grains.

The preferred bond system (i.e., slurry coat or make coat and size coat) is a resinous or glutinous adhesive. Examples of typical resinous adhesives include phenolic resins, urea-formaldehyde resins, melamine-formaldehyde resin, epoxy resins, acrylate resins, urethane resins, and combinations thereof. The bond system may contain other additives which are well known in the art, such as, for example, grinding aids, plasticizers, fillers, coupling agents, wetting agents, dyes and pigments.

In the first preferred conventional method for preparing a coated abrasive article, a make coat is applied to a major surface of the backing following by projecting a plurality of abrasive granules into the make coat. It is preferable in preparing the coated abrasive that the abrasive granules be electrostatically coated. The make coating is cured in a manner sufficient to at least partially solidify it such that a size coat can be applied over the abrasive granules. Next, the size coat is applied over the abrasive granules and the make coat. Finally, the make and size coats are fully cured. Optionally, a supersize coat can be applied over the size coat and cured.

Examples of useful materials which may be used in the supersize coat include the metal salts of fatty acids, urea-formaldehyde, novolak phenolic resins, waxes, mineral oils, and fluorochemicals. The preferred supersize is a metal salt of a fatty acid such as, for example, zinc stearate.

In the second preferred conventional method for preparing a coated abrasive article, a slurry containing abrasive granules dispersed in a bond material is applied to a major surface of the backing. The bond material is then cured. Optionally, a supersize coat can be applied over the slurry coat and cured.

In the above methods, the make coat and size coat or slurry coat can be solidified or cured by means known in the art, including, for example, heat or radiation energy.

The pressure-sensitive adhesive may comprise any of the materials commonly used for this purpose, and may be coated on the web by standard techniques. Suitable adhesives include those disclosed in U.S. Pat. No. Reissue 24,906 and U.S. Pat. No. 2,485,295, incorporated herein by reference. Acrylate copolymers, such as the 95.5:4.5 weight ratio copolymer of isooctyl acrylate and acrylic acid are particularly suitable. The pressure-sensitive adhesive is most conveniently applied to the web as a 100% solids hot melt formulation subsequent to coating the abrasive material.

The abrasive article also comprises a release liner in contact with the pressure-sensitive adhesive layer. The release liner may comprise any flexible material in sheet form, such as paper or plastic film, provided that the surface that contacts the pressure-sensitive adhesive exhibits release properties, i.e., is such that the liner may be readily peeled from the pressure-sensitive adhesive. Typically, the release liner comprises paper coated on one side with a silicone or fluoropolymer resin, such papers being readily available commercially. The release liner is generally placed in contact with the pressure-sensitive adhesive by a web lamination process.

The abrasive article further comprises a lift flap permanently adhered to the outer surface of the release liner, i.e. the surface not in contact with the pressure-sensitive adhesive in the manner described previously. The lift flap comprises any flexible sheet-form material such as paper or plastic film, paper being preferred for reasons of cost and convenience. The adhesive used for bonding the lift flap to the release liner may be selected from a wide variety of materials such as pressure-sensitive adhesives, hot melt adhesives, contact adhesives, etc. but pressure-sensitive adhesives are preferred for reasons of cost and convenience. The adhesive bond between the lift flap and the release liner must be stronger than that between the release liner and the layer of pressure-sensitive adhesive coated on the substrate. As indicated previously and described in greater detail below, the lift flap is conveniently applied to the release liner in strip form by a web lamination technique, either simultaneously with the lamination of the release liner or as a subsequent step. Depending on the width of the coated abrasive web and the dimensions of the abrasive articles to be cut therefrom, one or more strips of lift flap material are laminated to the release liner in the longitudinal direction of the web. Each strip is typically about 7 cm wide, although this can be varied, and either has a central stripe of adhesive, about 4 cm wide, for example, or has a stripe of adhesive along both edges extending inwards from the edges for about 2 cm, for example. These dimensions, after conversion of the web into separate abrasive articles, provide a lift flap about 1.5 cm wide, which is sufficient to enable a user to grasp it even when wearing gloves.

The outer surface of the strip of lift flap material, i.e. the surface not in contact with the release liner, may usefully have indicia printed on it, such as the manufacturer's logo, or production identification such as the abrasive grit size (P200, P400 etc.). Such information is conventionally printed on the back of the substrate or on the release liner, which usually requires the addition of a priming station to the manufacturing line. By having the information pre-printed on the lift flap material, the manufacturing line is simplified and its productivity increased, as there is less "down-time" when changing from one product to another.

BRIEF DESCRIPTION OF THE DRAWINGS

The invention will now be described with reference to the accompanying drawings in which

In FIGS. 1 and 2 like reference numerals represent like parts. The abrasive article comprises a substrate 2, e.g., paper, bearing a layer of abrasive material 4 on one major surface thereof. The abrasive layer 4 may comprise any suitable abrasive and may constitute a plurality of separate layers, e.g., size, make, etc.

Figure 1:
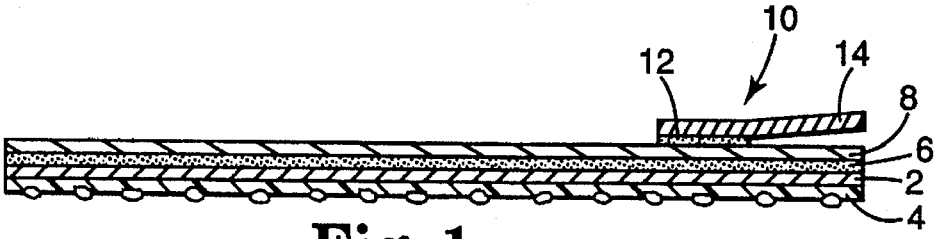
FIGS. 1 and 2 represent cross-sections through abrasive articles in accordance with the invention and FIGS. 3 and 4 represent plan views of webs during the manufacturing process.

The other major surface of the substrate 2 bears a layer of pressure-sensitive adhesive 6 which is covered by a release liner 8.

Lift material 10 is positioned at one edge of the release liner 8. The lift material 10 comprises an adhesive region 12 and a non-adhesive region 14. In accordance with the embodiment of FIG. 1 the adhesive region 12 is spaced from the edge of the liner and the non-adhesive region 14 is adjacent the edge. It will be noted that the edges of the abrasive material, liner and lift material are coterminous. The non-adhesive region 14 provides a simple effective lift flap or finger lift which enables the user to grasp the free portion 14 and peel the liner 8 away from the pressure-sensitive adhesive 6. The adhesive 12 is selected such that the bond strength between the liner and lift material 10 is greater than that between the liner and pressure-sensitive adhesive 6 to facilitate removal of the liner.

Figure 2:
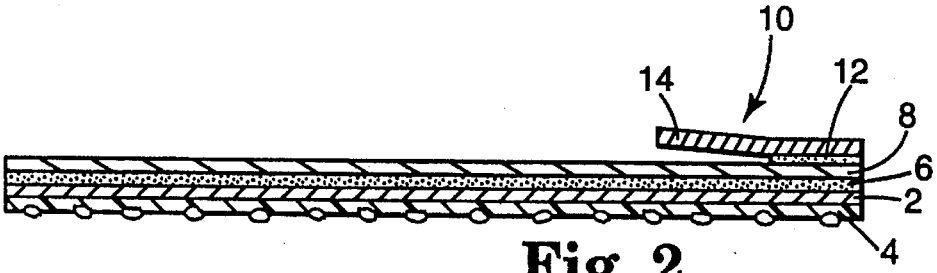

The embodiment shown in FIG. 2 differs from that in FIG. 1 in that the adhesive region 12 is positioned adjacent the edge of the liner 8 and the non-adhesive region 14 providing the lift flap is positioned inwardly from the edge.

Figure 3:
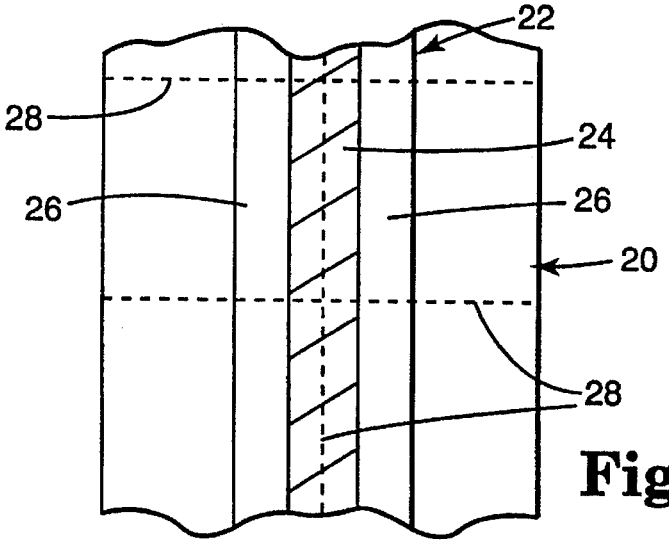
Figure 4:
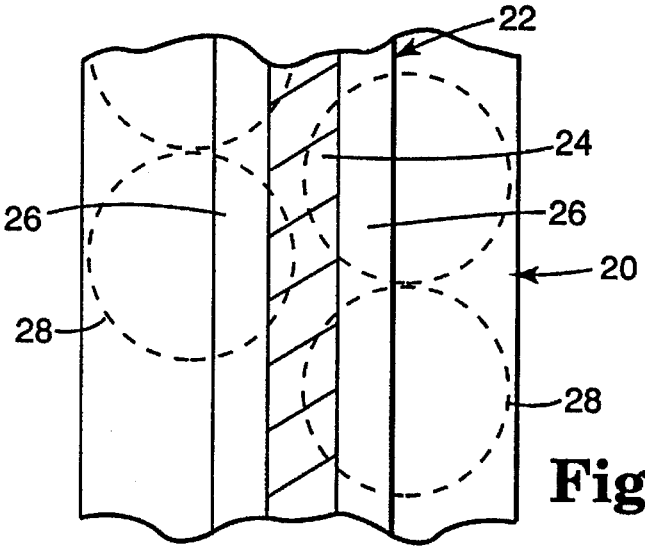

FIGS. 3 and 4 illustrate plan views of webs of abrasive material bearing a release liner and strip of lift material, the strip of lift material being uppermost. The web is generally shown at 20 and in accordance with the invention a strip of lift material 22 is applied to the web 20. The strip 22 is conveniently applied in the longitudinal direction of the web. The strip 22 comprises a central region 24 (cross-hatched area in FIGS. 3 and 4) and marginal regions 26. The central region 24 may be adhesive-free and the marginal regions 26 comprise adhesive to secure the strip 22 to the web or the marginal regions 26 may be adhesive-free and the central region 24 comprise adhesive to secure the strip 22 to the web.

The perimeters of the abrasive articles are shown in FIGS. 3 and 4 by the dotted outline 28. According to FIG. 3 the individual abrasive articles are rectangular in shape and in accordance with FIG. 4 the abrasive articles are circular in shape. It will be noted that a portion of the edge of each abrasive article is present in the central portion 24 of the lift material 22. When the central portion 24 comprises adhesive the resulting abrasive article will be in accordance with FIG. 2. When the central portion 24 is adhesive-free the resulting abrasive article will be in accordance with FIG. 1.

It will be appreciated that the web width and the dimensions of the individual abrasive articles may vary substantially and two or more strips of lift material 22 may be applied to a web in the appropriate positions for cutting the abrasive articles.

I claim:

1. An abrasive article comprising a substrate having a first major surface bearing an abrasive layer and a second major surface having a layer of pressure-sensitive adhesive and a protective liner covering said layer of pressure-sensitive adhesive, the liner having a perimeter coterminous with the perimeter of said substrate in which the liner has a lift flap secured thereto with a greater bond strength therebetween than the bond strength developed between the liner and the pressure-sensitive adhesive, the lift flap not extending beyond the perimeter of the liner and having free portion accessible to finger grip.

2. An abrasive article as claimed in claim 1 in which the substrate is selected from the group consisting of paper, cloth and plastic film.

3. An abrasive article as claimed in claim 1 in which the protective liner is selected from the group consisting of paper and plastic film.

4. An abrasive article as claimed in claim 3 in which the liner has a coating of a release agent on the surface adjacent the pressure-sensitive adhesive layer.

5. An abrasive article as claimed in claim 1 in which the free portion of the lift flap is adjacent the edge of the liner.

6. An abrasive article as claimed in claim 1 in which the lift flap is secured to the liner adjacent the edge of the liner.

7. An abrasive article as claimed in claim 1 in which the lift flap is secured to the liner by adhesive.

8. An abrasive article as claimed in claim 1 in which the lift flap comprises paper or plastic film.

9. An abrasive article as claimed in claim 1 in the form of a rectangular sheet or circular disc.

10. A method of making an abrasive article which comprises:

providing a web comprising a substrate having a first major surface bearing an abrasive layer and a second major surface having a layer of pressure-sensitive adhesive and a protective liner covering said layer of pressure-sensitive adhesive layer and being secured thereto with a bond strength therebetween, providing a strip of lift material comprising a backing having a major surface having a region bearing an adhesive layer and a non-adhesive region free from adhesive, applying said strip to the liner of the web, and cutting said web and strip to form abrasive materials such that the liner of the abrasive material has a lift flap secured thereto with a bond strength therebetween in which the bond strength of the strip to the liner is greater than the bond strength of the liner to the pressure-sensitive adhesive layer, to aid removal of the liner from the pressure-sensitive adhesive, the lift flap not extending beyond the perimeter of the liner and having free portion accessible to finger grip.

11. A method as claimed in claim 10 in which the strip comprises a central non-adhesive stripe and an adhesive region on either side thereof, the web and strip being cut such that the free-portion of the lift flap is formed on the abrasive material adjacent the edge of the liner.

12. A method as claimed in claim 10 in which the strip comprises a central stripe of adhesive and a non-adhesive region on either side thereof, the web and strip being cut such that the lift flap is bonded to the liner of the abrasive material adjacent an edge.

13. A method as claimed in claim 10 in which the backing of the strip comprises paper or plastic film.

14. A method as claimed in claim 10 in which the web is cut into rectangles or circles.

* * * * *